US009403386B2

(12) United States Patent
Lo et al.

(10) Patent No.: US 9,403,386 B2
(45) **Date of Patent: *Aug. 2, 2016**

(54) SERVICE MODULE POSITION WITHIN PRINTER

(71) Applicant: Hewlett-Packard Development Company, L.P., Houston, TX (US)

(72) Inventors: Kevin Lo, Vancouver, WA (US); Wesley R. Schalk, Vancouver, WA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 93 days.

This patent is subject to a terminal disclaimer.

(21) Appl. No.: 14/510,739

(22) Filed: Oct. 9, 2014

(65) Prior Publication Data

US 2015/0022608 A1 Jan. 22, 2015

Related U.S. Application Data

(63) Continuation of application No. 13/750,554, filed on Jan. 25, 2013, now Pat. No. 8,899,741.

(51) Int. Cl.

| | |
|---|---|
| ***B41J 13/10*** | (2006.01) |
| ***B41J 13/00*** | (2006.01) |
| ***B41J 3/62*** | (2006.01) |
| ***B41J 3/60*** | (2006.01) |
| ***B41J 11/00*** | (2006.01) |
| *B41J 3/54* | (2006.01) |

(52) U.S. Cl.

CPC .. *B41J 13/10* (2013.01); *B41J 3/60* (2013.01); *B41J 3/62* (2013.01); *B41J 11/006* (2013.01); *B41J 13/009* (2013.01); *B41J 3/54* (2013.01)

(58) Field of Classification Search

CPC ..... B41J 2002/17579; B41J 2/17566; B41J 13/10; B41J 3/54; B41J 3/60; B41J 3/62

USPC ..... 347/104, 101, 16, 153

See application file for complete search history.

(56) References Cited

U.S. PATENT DOCUMENTS

| | | | | |
|---|---|---|---|---|
| 4,646,111 | A * | 2/1987 | Shimosato | B41J 2/06 101/93.05 |
| 4,692,020 | A | 9/1987 | Tsujihara | |
| 4,777,498 | A | 10/1988 | Kasamura et al. | |
| 5,448,348 | A | 9/1995 | Azeta | |
| 5,620,269 | A | 4/1997 | Gustafson | |
| 5,746,526 | A | 5/1998 | Hirose | |
| 5,865,121 | A | 2/1999 | Testardi et al. | |
| 6,042,109 | A | 3/2000 | Klausbruckner | |
| 6,217,146 | B1 * | 4/2001 | Takahashi | B41J 2/16508 347/33 |
| 6,487,382 | B2 | 11/2002 | Underwood et al. | |
| 7,120,383 | B2 | 10/2006 | Sato et al. | |
| 7,744,077 | B2 | 6/2010 | Buxton et al. | |
| 8,899,741 | B2 * | 12/2014 | Lo | B41J 3/62 347/101 |
| 2006/0187245 | A1 * | 8/2006 | Kudoh | B41J 2/1652 347/3 |

* cited by examiner

*Primary Examiner* — Henok Legesse
(74) *Attorney, Agent, or Firm* — HP Inc. Patent Department

(57) ABSTRACT

A printer includes a print engine to print on print media within a print zone, a media tray to hold a quantity of the print media, and at least one service module to service the print engine, wherein the at least one service module is at least one of positioned vertically of the print engine and laterally of the media tray, and positioned laterally of the print engine and vertically of the media tray.

18 Claims, 5 Drawing Sheets

SERVICE MODULE POSITION WITHIN PRINTER

CROSS-REFERENCE TO RELATED APPLICATIONS

This application is a Continuation of copending U.S. patent application Ser. No. 13/750,554, filed on Jan. 25, 2013, and incorporated herein by reference.

BACKGROUND

A printer may include a print media path to move and/or route print media through the printer, a print engine to print on the print media, a duplexer to facilitate printing on both sides of the print media, and a service station to service the print engine. For use in an office environment, printer features such as printed media being output face-down in an output bin (for example, for security, confidential, and/or privacy concerns), minimal occupied footprint, and/or convenient use height, may be considered.

DETAILED DESCRIPTION

In the following detailed description, reference is made to the accompanying drawings which form a part hereof, and in which is shown by way of illustration specific examples in which the disclosure may be practiced. In this regard, directional terminology, such as "top," "bottom," "front," "back," "leading," "trailing," etc., is used with reference to the orientation of the Figure(s) being described. Because components of examples of the present disclosure can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Figure 1:
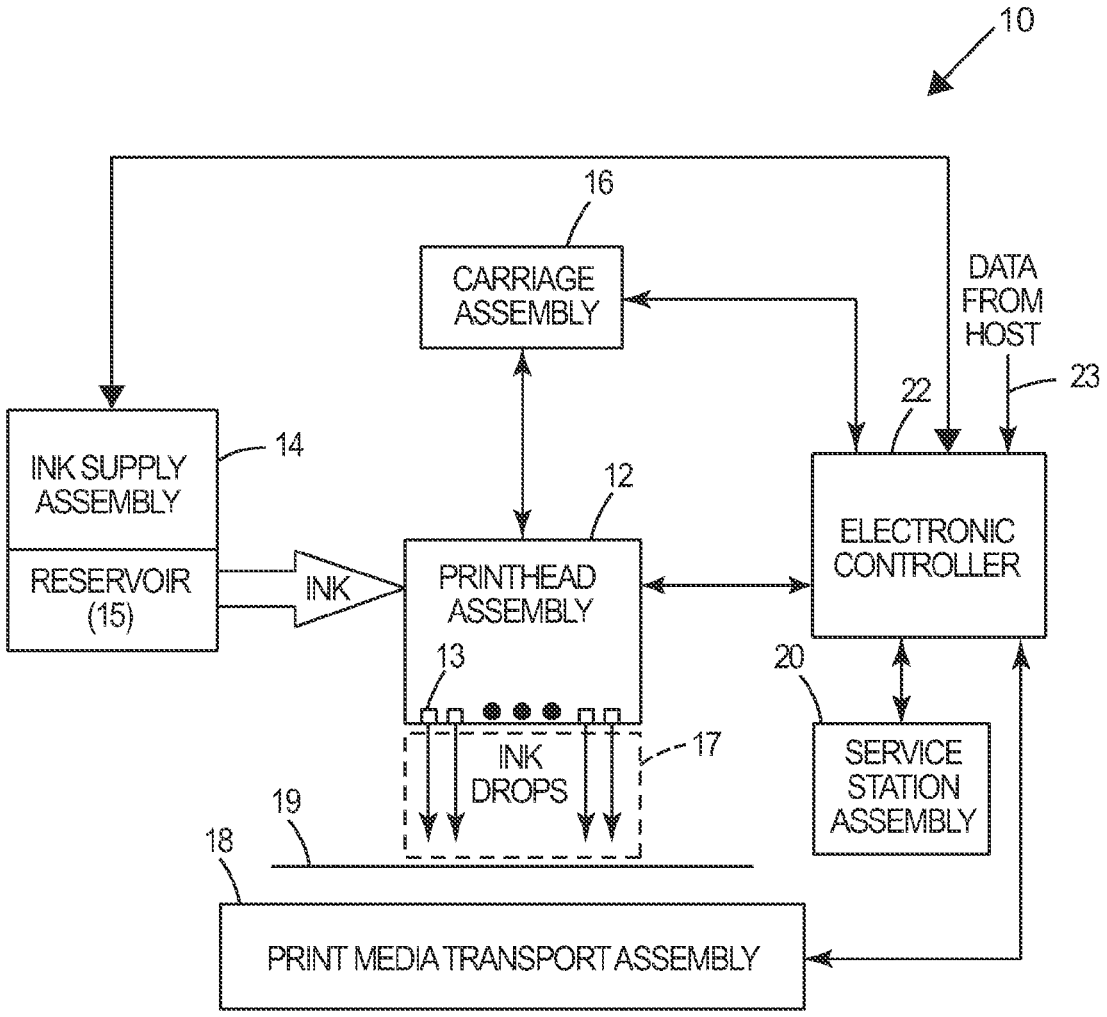
FIG. 1 is a block diagram illustrating one example o an inkjet printing system.

FIG. 1 illustrates one example of an inkjet printing system 10. Inkjet printing system 10 includes a fluid ejection assembly, such as printhead assembly 12, and a fluid supply assembly, such as ink supply assembly 14. In the illustrated example, inkjet printing system 10 also includes a carriage assembly 16, a print media transport assembly 18, a service station assembly 20, and an electronic controller 22.

Printhead assembly 12 includes one or more printheads or fluid ejection devices which eject drops of ink or fluid through a plurality of orifices or nozzles 13. In one example, the drops are directed toward a medium, such as print media 19, so as to print onto print media 19. Print media 19 includes any type of suitable sheet material, such as paper, card stock, transparencies, Mylar, fabric, and the like. Typically, nozzles 13 are arranged in one or more columns or arrays such that properly sequenced ejection of ink from nozzles 13 causes characters, symbols, and/or other graphics or images to be printed upon print media 19 as printhead assembly 12 and print media 19 are moved relative to each other.

Ink supply assembly 14 supplies ink to printhead assembly 12 and includes a reservoir 15 for storing ink. As such, in one example, ink flows from reservoir 15 to printhead assembly 12. In one example, printhead assembly 12 and ink supply assembly 14 are housed together in an inkjet or fluid-jet print cartridge or pen. In another example, ink supply assembly 14 is separate from printhead assembly 12 and supplies ink to printhead assembly 12 through an interface connection, such as a supply tube.

Carriage assembly 16 positions printhead assembly 12 relative to print media transport assembly 18 and print media transport assembly 18 positions print media 19 relative to printhead assembly 12. Thus, a print zone 17 is defined adjacent to nozzles 13 in an area between printhead assembly 12 and print media 19. In one example, printhead assembly 12 is a scanning type printhead assembly such that carriage assembly 16 moves printhead assembly 12 relative to print media transport assembly 18. In another example, printhead assembly 12 is a non-scanning type printhead assembly such that carriage assembly 16 fixes printhead assembly 12 at a prescribed position relative to print media transport assembly 18.

Service station assembly 20 provides for spitting, wiping, capping, and/or priming of printhead assembly 12 in order to maintain a functionality of printhead assembly 12 and, more specifically, nozzles 13. For example, service station assembly 20 may include a rubber blade or wiper which is periodically passed over printhead assembly 12 to wipe and clean nozzles 13 of excess ink. In addition, service station assembly 20 may include a cap which covers printhead assembly 12 to protect nozzles 13 from drying out during periods of non-use, in addition, service station assembly 20 may include a spittoon into which printhead assembly 12 ejects ink to insure that reservoir 15 maintains an appropriate level of pressure and fluidity, and insure that nozzles 13 do not clog or weep. Functions of service station assembly 20 may include relative motion between service station assembly 20 and printhead assembly 12. Electronic controller 22 communicates with printhead assembly 12, carriage assembly 16, print media transport assembly 18, and service station assembly 20. Thus, in one example, when printhead assembly 12 is mounted in carriage assembly 16, electronic controller 22 and printhead assembly 12 communicate via carriage assembly 16. Electronic controller 22 also communicates with ink supply assembly 14 such that, in one implementation, a new (or used) ink supply may be detected, and a level of ink in the ink supply may be detected.

Electronic controller 22 receives data 23 from a host system, such as a computer, and may include memory for temporarily storing data 23. Data 23 may be sent to inkjet printing system 10 along an electronic, infrared, optical or other information transfer path. Data 23 represents, for example, a document and/or file to be printed. As such, data 23 forms a print job for inkjet printing system 10 and includes one or more print job commands and/or command parameters.

In one example, electronic controller 22 provides control of printhead assembly 12 including timing control for ejection of ink drops from nozzles 13. As such, electronic controller 22 defines a pattern of ejected ink drops which form characters, symbols, and/or other graphics or images on print media 19. Timing control and, therefore, the pattern of ejected ink drops, is determined by the print job commands and/or command parameters. In one example, logic and drive circuitry forming a portion of electronic controller 22 is located on printhead assembly 12. In another example, logic and drive circuitry forming a portion of electronic controller 22 is located off printhead assembly 12.

Figure 2:
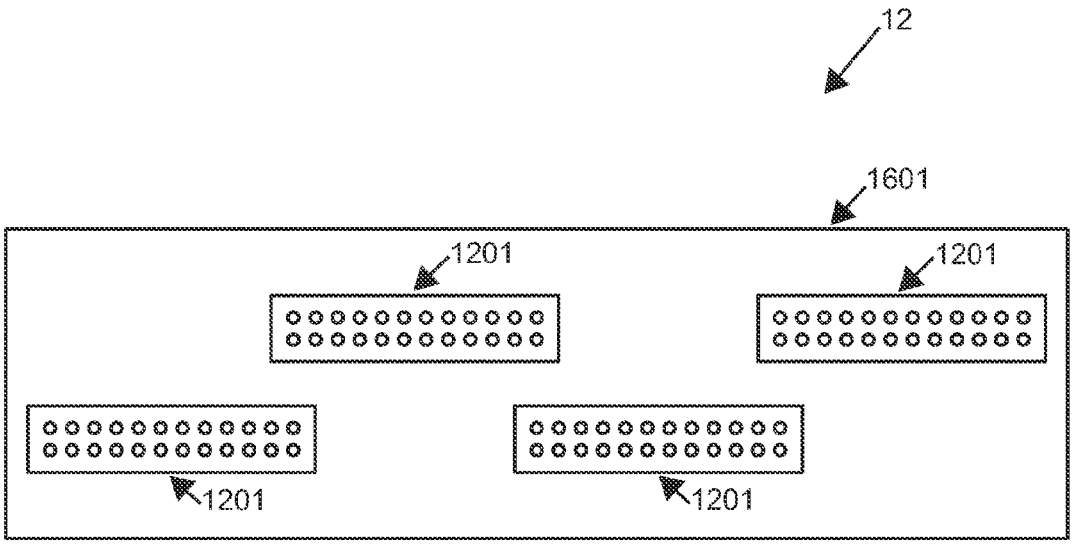
FIG. 2 is a schematic illustration of one example of a printhead assembly of an inkjet printing system.

In one example, as illustrated in FIG. 2, printhead assembly 12 is a wide-array or multi-head printhead assembly and includes a carrier 1601, as an example of carriage assembly 16, and a plurality of printhead dies 1201 mounted on carrier 1601. In one implementation, printhead dies 1201 are arranged and aligned in one or more overlapping rows (as oriented in FIG. 2) such that printhead dies 1201 in one row overlap at least one printhead die 1201 in another row. As such, printhead assembly 12 may span a nominal page width or a width shorter or longer than a nominal page width. For example, printhead assembly 12 may span 8.5 inches of a Letter size print medium or a distance greater than or less than 8.5 inches of the Letter size print medium. While four printhead dies 1201 are illustrated as being mounted on carrier 1601, the number of printhead dies 1201 mounted on carrier 1601 may vary.

In one implementation, printhead assembly 12, as a wide-array or multi-head printhead assembly including printhead dies 1201, is a non-scanning type printhead assembly such that carrier 1601 fixes printhead assembly 12 at a prescribed position relative to print media transport assembly 18 (FIG. 1). With a position of printhead assembly 12 fixed, print media 19 (FIG. 1) is moved or advanced relative to printhead assembly 12 during printing.

Figure 3:
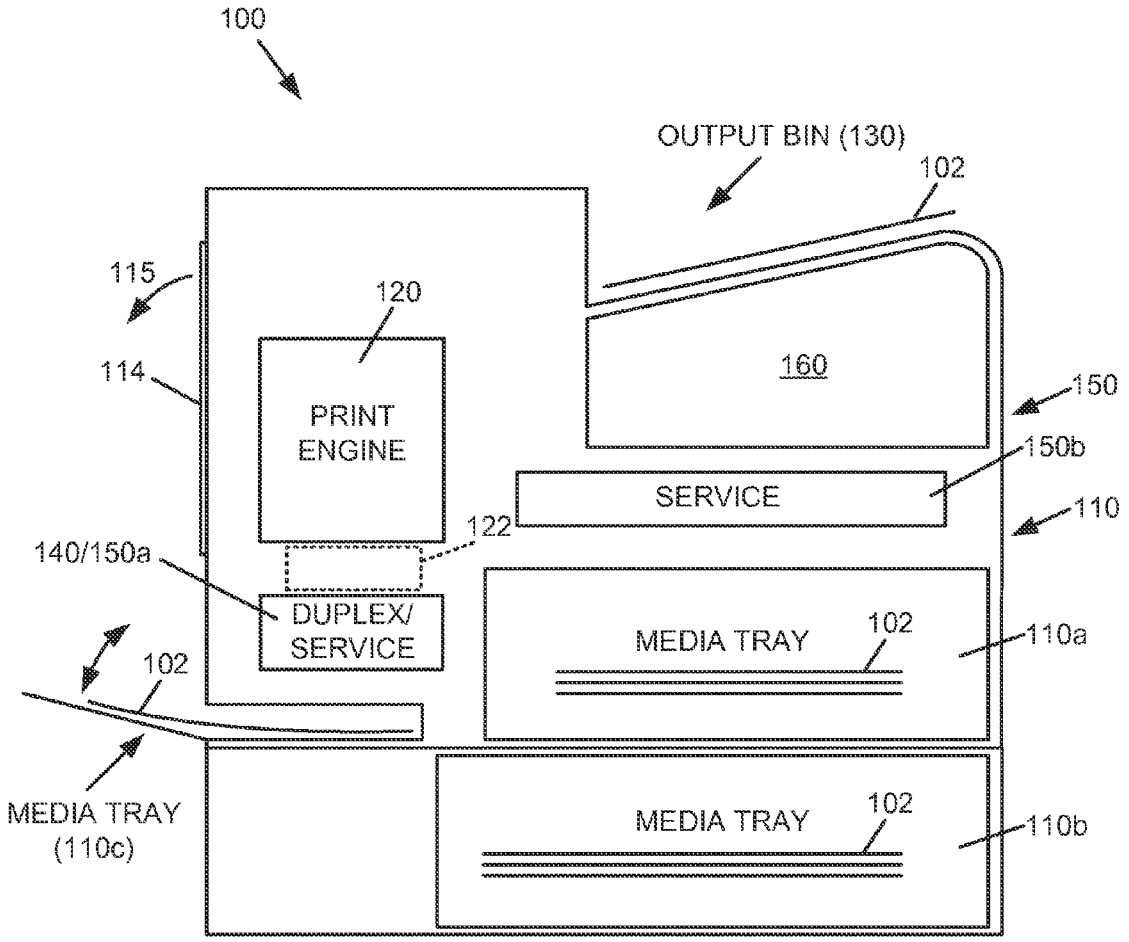
FIG. 3 is a schematic illustration of one example of a layout of a portion of a printer.

FIG. 3 is a schematic illustration of one example of a layout of a portion of a printer 100. In one implementation, printer 100 includes one or more input trays 110 to supply print media 102, as an example of print media 19, a print engine 120 to print on print media 102, an output tray or bin 130 to receive printed print media 102, a duplex module 140 to facilitate two-sided printing on print media 102, and one or more service modules 150 to service print engine 120.

Input trays 110, as described below, supply a bulk quantity of print media 102 or supply a single quantity of print media 102 to print engine 120 for printing on print media 102 by print engine 120. In one implementation, input trays 110 include a main media tray 110*a*, an accessory or auxiliary media tray 110*b*, and a manual or bypass media tray 1100 (also known as a multi-purpose tray). In one example, main media tray 110*a* and/or auxiliary media tray 110*b* each have a 500 sheet capacity (i.e., one ream).

In one implementation, bypass media tray 110*c* includes a door 112 which is selectively opened (and closed) (as indicated by the double arrow) to facilitate manual input of print media 102 to printer 100. More specifically, bypass media tray 110*c* receives manual input of print media 102 from externally of printer 100 such that print media 102 is directed to print engine 120 for printing, as described below. Print media manually input to printer 100 may include, for example, envelopes, letterhead, checks, or other print media suited for single or manual input.

Print engine 120 can be a laser print engine, an inkjet print engine, or any other type of print engine. in one implementation, a print area or print zone 122 is defined in which printing on print media 102 by print engine 120 occurs. In one example, printer 100 is implemented as an inkjet printing system, such as inkjet printing system 10, and print engine 120 includes, for example, printhead assembly 12. When print engine 120 is implemented as an example of printhead assembly 12, print zone 122 includes print zone 17 as defined between printhead assembly 12 and print media 19 (FIG. 1).

Output bin 130 is provided at an end of a print media path through printer 100, as described below. In one implementation, output bin 130 holds printed output in a face-down orientation (i.e., the side of the print media just printed by the print engine faces the output bin when the printed print media is output), By providing face-down output in output bin 130, security, confidential, and/or privacy concerns are addressed since a front of the printed print media 102 is not visible. In addition, with face-down output in output bin 130, a correct print order of a multi-page print job may be achieved in that a first page of the multi-page print job may be printed first and output first (FIFO). As such, processing time of a multi-page print job may be minimized since each page of the multi-page print job may be processed in-order (i.e., first to last) as compared to reverse processing of a multi-page print (i.e., last page first) and outputting of the multi-page print job in a face-up orientation.

Duplex module 140 can be operated to facilitate printing on both sides of print media 102, as described below. In addition, service modules 150*a* and/or 150*b* provide for servicing of print engine 120, and may be implemented as examples of service station assembly 20 to provide for spitting, wiping, capping and/or priming of printhead assembly 12, as described above, when print engine 120 is implemented as an example of printhead assembly 12.

In one example, an access door 114 (openable in the direction indicated by arrow 115) is provided at a side of printer 100 adjacent print engine 120 and duplex module 140, and adjacent the print media path provided through printer 100 described below, to provide access, for example, for the clearance of print media jams.

Figure 4:
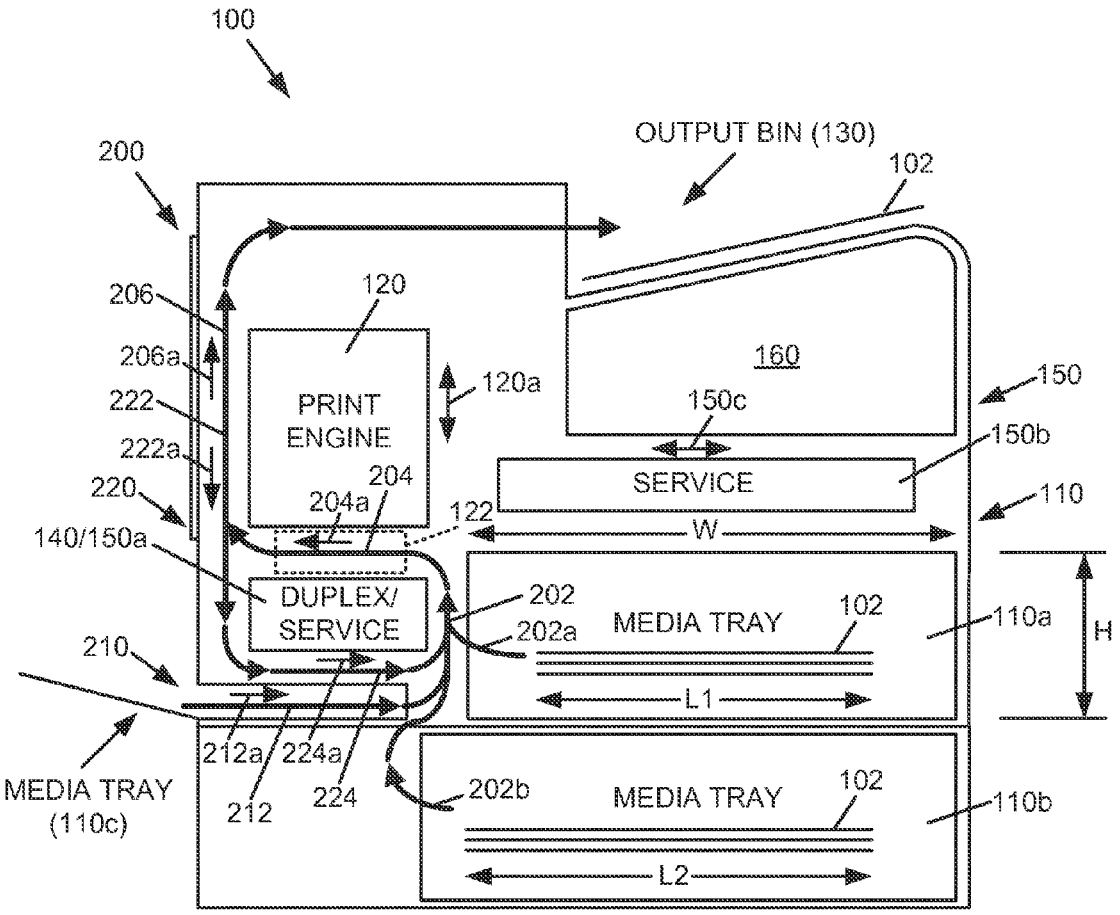
FIG. 4 is a schematic illustration of one example of a media handling layout of the printer of FIG. 3.

FIG. 4 is a schematic illustration of one example of a media handling layout of printer 100. The media handling layout of printer 100 may include a variety of guides, rollers, wheels, etc. to achieve the handling and routing of print media described below. As illustrated in the example of FIG. 4, printer 100 includes a print media path 200 which routes print media 102 through printer 100 for printing on print media 102 by print engine 120. More specifically, print media path 200 routes print media 102 from one or more of input trays 110, to and through print zone 122 of print engine 120, and to output bin 130.

In one implementation, print media path 200 includes an input path portion 202, a print path portion 204, and an output path portion 206. Input path portion 202 communicates with and receives input of print media 102 from main media tray 110*a*, accessory or auxiliary media tray 110*b*, and/or bypass media tray 110*c* such that, in one implementation, input path portion 202 provides a common input path for all three media trays. Print path portion 204 communicates with and receives print media 102 from input path portion 202, and directs print media 102 through print zone 122 for printing on print media 102 by print engine 120. Output path portion 206 communicates with and receives print media 102 from print path portion 204, and directs printed print media 102 for output at output bin 130.

In one implementation, print path portion 204 of print media path 200 includes a portion which directs print media 102 through print zone 122 in a direction indicated by arrow 204*a*, and output path portion 206 of print media path 200 includes a portion which directs print media 102 toward output bin 130 in a direction indicated by arrow 206*a*. In one example, the direction indicated by arrow 204*a* is substantially horizontal, and the direction indicated by arrow 206*a* is substantially vertical such that the direction indicated by arrow 206*a* is substantially perpendicular to the direction indicated by arrow 204*a*.

In one implementation, a main media path portion 202*a* communicates with and extends between main media tray

110*a* and input path portion 202, and an auxiliary media path portion 202*b* communicates with and extends between auxiliary media tray 110*b* and input path portion 202. In one example, auxiliary media path portion 202*b* includes a C-shaped or reversing path portion to accommodate different size print media in auxiliary media tray 110*b* as compared with main media tray 110*a* (for example, longer media as noted by L2 versus L1). More specifically, with auxiliary media path portion 202*b* providing a C-shaped or a reversing path portion, a right side of main media tray 110*a* and a right side of auxiliary media tray 110*b* (as oriented in the drawings) may be aligned with each other while a common input path (for example, input path portion 202) may be maintained.

As illustrated in the example of FIG. 4, printer 100 includes a bypass media path 210 which communicates with and extends between bypass media tray 110*c* and input path portion 202 of print media path 200. As such, bypass media path 210 communicates to an exterior of printer 100 to receive print media 102 from externally of printer 100 and direct print media 102 to input path portion 202 of print media path 200.

In one implementation, bypass media path 210 includes a bypass path portion 212 which directs print media 102 to print media path 200 in a direction indicated by arrow 212*a*. In one example, the direction indicated by arrow 212*a* is in a direction opposite the direction indicated by arrow 204*a* such that the direction that bypass path portion 212 directs print media 102 to print media path 200 (i.e., input path portion 202) is opposite the direction that print path portion 204 directs print media 102 through print zone 122. As such, a compact arrangement of print media path 200 and bypass media path 210 is obtained.

As illustrated in the example of FIG. 4, printer 100 includes a duplex media path 220 which receives print media 102 and redirects print media 102 to print media path 200, including, for example, to print path portion 204, to facilitate printing on a second side of print media 102. More specifically, after print media 102 is printed on a first side, duplex media path 220 reverses an orientation of print media 102 (i.e., "flips" print media 102) such that print media 102 is oriented for printing on a second side. After print media 102 is printed on the second side, print media 102 is routed by print media path portion 200, including, for example, by output path portion 206, to output bin 130, as described above.

In one implementation, duplex media path 220 includes a reversing path portion 222 and a duplexing path portion 224. In one example, reversing path portion 222 is provided by a portion of output path portion 206 such that reversing path portion 222 coincides with output path portion 206. As such, reversing path portion 222 receives print media 102 from print path portion 204 and reverses a direction of print media 102, as indicated by arrow 222*a*, thereby reversing an orientation of print media 102 for duplex printing.

In one example, output path portion 206 is of sufficient length such that print media 102 in reversing path portion 222 remains concealed within printer 100 while a direction of print media 102 is reversed. As such, print media 102 is not exposed externally of printer 100 during a duplex operation. Thus, a user is prevented from touching or pulling print media 102 during a duplex operation.

Duplexing path portion 224 receives print media 102 from reversing path portion 222 and redirects print media 102 to print path portion 204 of print media path 200 (for example, via input path portion 202). In one implementation, during redirection of print media 102 to print path portion 204, duplexing path portion 224 includes a portion which directs print media 102 in a direction indicated by arrow 224*a*. In one example, the direction indicated by arrow 224*a* is opposite the direction indicated by arrow 204*a* such that the direction that duplexing path portion 224 directs print media 102 to print path portion 204 is opposite the direction that print path portion 204 directs print media 102 through print zone 122. As such, a compact arrangement of print media path 200 and duplex media path 220 is obtained.

In one example, one sheet of print media 102 may be routed through duplex media path 220 while another sheet of print media 102 is being routed through print media path 200 including, more specifically, while another sheet of print media 102 is being routed through print path portion 204 and print zone 122. Thus, increased throughput may be achieved since duplexing of one sheet (i.e., flipping) and printing of another sheet may be performed in parallel.

As schematically illustrated in the example of FIG. 4, components of printer 100 are arranged to provide a compact and efficient design of printer 100. For example, duplex module 140 is positioned adjacent and laterally of main media tray 110*a* and "overlaps" main media tray 110*a* in a vertical position or direction. As such, duplexing path portion 224 is positioned adjacent and laterally of main media tray 110*a* within a height (H) of main media tray 110*a*. Thus, main media tray 110*a* can accommodate a larger quantity of print media (for example, 500 sheets) without increasing a total height of printer 100. In addition, bypass media path 210 is positioned adjacent and laterally of main media tray 110 and bypass media tray 110*c* overlaps main media tray 110*a* in a vertical position or direction. As such, bypass path portion 212 is positioned adjacent and laterally of main media tray 110 within a height (H) of main media tray 110*a*.

In one implementation, service module 150*a* is combined with duplex module 140 and is positioned adjacent and laterally of main media tray 110*a* in an area under print zone 122 and print engine 120. In addition, service module 150*b* is positioned adjacent and laterally of print engine 120 in an area above main media tray 110*a* such that print engine 120 is moved vertically (as indicated by double arrow 120*a*) and service module 150*b* is moved horizontally (as indicated by double arrow 150*c*) to service print engine 120. As such, service module 150*a* is positioned adjacent and laterally of main media tray 110*a* within a height (H) of main media tray 1108, and service module 150*b* is positioned vertically of main media tray 110*a* within a width (W) of main media tray during non-servicing of print engine 120. Accordingly, a compact and efficient design of printer 100 is obtained, In addition, with space provided above service module 150*b* within a height of print engine 120, output bin 130 can accommodate a larger quantity of printed print media (for example, 500 sheets) without increasing a total height of printer 100.

In one implementation, output bin 130 "overlaps" a footprint of (or is "nested" within) printer 100 such that minimal overhang of outputted print media 102 occurs beyond output bin 130. In addition, bypass media tray 110*c* is provided with an opening extending into printer 100 whereby bypass media tray 110*c* "overlaps" a footprint of (or is "nested" within) printer 100 such that minimal overhang of inputted print media 102 occurs beyond bypass media tray 110*c*. As such, with minimal overhang of outputted print media 102 from output bin 130 and minimal overhang of inputted print media 102 from bypass media tray 110*c*, an operational width of printer 100 and, therefore, an occupied footprint of printer 100, may be reduced.

Figure 5:
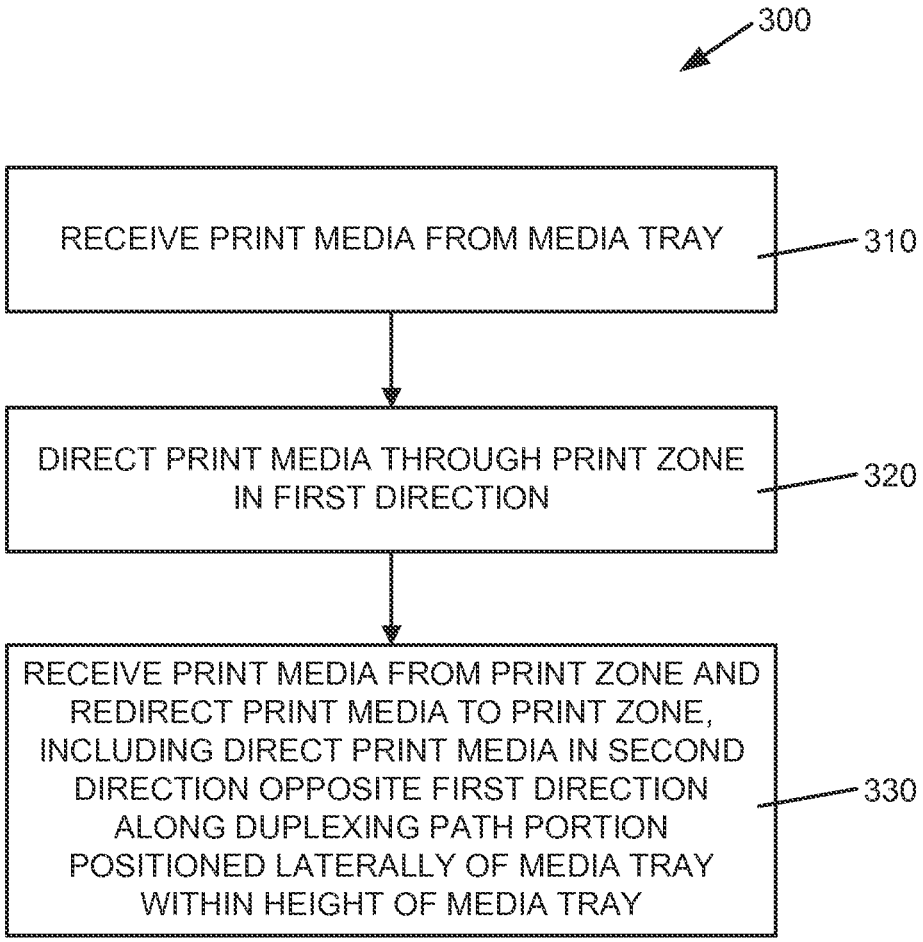
FIG. 5 is a flow diagram illustrating one example of a method of operating a printer.

In one implementation, a storage space 160 is provided below output bin 130 in an area above service module 150*b*, and, in one example, is provided laterally of an area of print engine 120. In one example, output bin 130 forms a roof profile of storage space 160. In addition, in one example, storage space 160 is an open (or exposed) storage space such that storage space 160, in one example, is open to a front of printer 100, or, in another example, is open to both a front and a back of printer 100. Thus, in one implementation, storage space 160 is permanently open to a front of printer 100, or, in another implementation, is permanently open to a front and a back of printer 100. As such, storage space 160 may provide an area for convenient storage of items usable or associated with printer 100, such as, for example, additional print media, a stapler, etc. FIG. 5 is a flow diagram illustrating one example of a method 300 of operating a printer, such as printer 100. With method 300, at 310, print media, such as print media 102, is received from a media tray, such as main media tray 110*a*, as schematically illustrated in the example of FIG. 4. The print media may also be received from auxiliary media tray 110*b* or bypass media tray 110*c*, also as schematically illustrated in the example of FIG. 4.

At 320, the print media, such as print media 102, is directed through a print zone of the printer, such as print zone 122 of printer 100, in a first direction, such as direction 204*a*, as schematically illustrated in the example of FIG. 4. More specifically, the print media is directed along a print media path, such as print media path 200, as schematically illustrated in the example of FIG. 4. In one example, the print media is directed along an input path, such as input path portion 202, and directed along a print path, such as print path portion 204, in the direction indicated by arrow 204*a*. As such, print engine 120 may print on the print media as the print media is routed through print zone 122.

At 330, the print media, such as print media 102, is received from the print zone, such as print zone 122, and redirected to the print zone, such as print zone 122, as schematically illustrated in the example of FIG. 4. More specifically, redirecting the print media to the print zone includes directing the print media in a second direction opposite the first direction, such as the direction indicated by arrow 224*a*. In one example, redirecting the print media to the print zone includes directing the print media along a duplexing path portion positioned laterally of the main media tray within a height of the main media tray, such as duplexing path portion 224 positioned adjacent and laterally of main media tray 110*a* within height (H) of main media tray 110*a*, as schematically illustrated in the example of FIG. 4.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed is:

1. A printer, comprising:

a print engine to print on print media within a print zone;

a media tray to hold a quantity of the print media within the printer, the media tray having a height and a width;

a service module to service the print engine, the service module spaced from and positioned vertically of the print engine and laterally of the media tray within the height of the media tray; and another service module to service the print engine, the another service module spaced from and positioned laterally of the print engine and vertically of the media tray within the width of the media tray.

2. The printer of claim 1, wherein the service module is positioned vertically below the print engine.

3. The printer of printer of claim 1, wherein the another service module is positioned vertically above the media tray.

4. The printer of claim 1, wherein the service module is positioned within the height of the media tray and vertically below the print engine, and the another service module is positioned within the width of the media tray and vertically above the media tray.

5. The printer of claim 1, further comprising: an output bin positioned vertically above the media tray.

6. The printer of claim 1, wherein the service module is positioned vertically of the print engine and laterally of the media tray within the height of the media tray between a bottom of the media tray and a top of the media tray, and the another service module is positioned laterally of the print engine and vertically of the media tray within the width of the media tray between opposite sides of the media tray.

7. A printer, comprising:

a print engine to print on print media within a print zone;

a media tray to hold a quantity of the print media within the printer the media tray having a height and a width;

a service module for servicing the print engine, the service module positioned within the height of the media tray between a bottom of the media tray and a top of the media tray; and another service module for servicing the print engine, the another service module positioned within the width of the media tray between opposite sides of the media tray.

8. The printer of claim 7, wherein the service module is positioned within the height of the media tray and vertically of the print engine.

9. The printer of claim 8, wherein the service module is positioned vertically below the print engine.

10. The printer of claim 7, wherein the another service module is positioned within the width of the media tray and vertically of the media tray.

11. The printer of claim 10, wherein the another service module is positioned vertically above the media tray.

12. The printer of claim 7, wherein the service module is positioned within the height of the media tray and vertically below the print engine, and the another service module is positioned within the width of the media tray and vertically above the media tray.

13. The printer of claim 7, wherein the service module and the another service module are both spaced from the print engine.

14. A method of operating a printer, comprising;

storing print media in a media tray within the printer, the print media to be printed on by a print engine, and the media tray having a height and a width;

servicing the print engine with a service module positioned laterally of the media tray within the height of the media tray between a bottom of the media tray and a top of the media tray; and servicing the print engine with another service module positioned vertically of the media tray within the width of the media tray between opposite sides of the media tray during non servicing of the print engine.

15. The method of claim 14, wherein servicing the print engine includes servicing the print engine with the service module positioned vertically below the print engine and laterally of the media tray within the height of the media tray.

16. The method of claim 14, wherein servicing the print engine includes servicing the print engine with the another service module positioned laterally of the print engine and vertically above the media tray within the width of the media tray during non-servicing of the print engine.

17. The method of claim 14, wherein the service module is positioned vertically below the print engine, and the another service module is positioned vertically above the media tray during non-servicing of the print engine.

18. The method of claim 14, wherein the service module and the another service module are both spaced from the print engine during non-servicing of the print engine.

* * * * *